US008360075B2

(12) United States Patent
Winn

(10) Patent No.: US 8,360,075 B2
(45) Date of Patent: Jan. 29, 2013

(54) HAIR WEAVING APPARATUS AND METHOD FOR MAKING AND USING

(76) Inventor: Queen Esther Winn, Savannah, GA (US)

( * ) Notice: Subject to any disclaimer, the term of this patent is extended or adjusted under 35 U.S.C. 154(b) by 172 days.

(21) Appl. No.: 12/804,054

(22) Filed: Jul. 13, 2010

(65) Prior Publication Data

US 2011/0005543 A1 Jan. 13, 2011

Related U.S. Application Data

(60) Provisional application No. 61/270,755, filed on Jul. 13, 2009.

(51) Int. Cl.
*A41G 5/00* (2006.01)

(52) U.S. Cl. ..... 132/201; 132/56

(58) Field of Classification Search ..... 132/201, 132/53–56; 139/29, 33, 33.5; 289/16.5
See application file for complete search history.

(56) References Cited

U.S. PATENT DOCUMENTS 2,695,621 A * 11/1954 Cox ..... 132/56
3,605,761 A * 9/1971 Margo ..... 132/201

* cited by examiner

*Primary Examiner* — Rachel Steitz
(74) *Attorney, Agent, or Firm* — Sonya C. Harris; Invention Services

(57) ABSTRACT

A hair weaving apparatus and method for making and using same. The present invention comprises various embodiments for making a hair weave tract extension apparatus and a method of making and using said apparatus. Embodiments are described and shown herein for making and using a hair weave tract apparatus with attachment means comprising a crimped flexible band and, and with attachment means comprising a crimped flexible band with a single bladed comb. It is an object of this present invention to provide a hair weave tract extension that is easy to attach to the natural hair, is less damaging to the natural hair and remains more securely attached to the natural hair.

13 Claims, 23 Drawing Sheets

HAIR WEAVING APPARATUS AND METHOD FOR MAKING AND USING

PRIOR APPLICATIONS

This application claims pendency to a prior Provisional Application filed Jul. 13, 2009, Ser. No. 61/270,755 entitled, Hair Weaving Apparatus and Method for Making and Using.

FIELD OF INVENTION

This invention relates to hair weaving, specifically, and particularly to the improved method for making and attaching hair weaves to the natural hair of a person.

BACKGROUND

A number of different types of hair extensions and application or attachment techniques have been developed over the years. More recently, the application of relatively smaller hairpieces, as opposed to wigs and such, has been developed and used more frequently. Many different attachment techniques have been developed and applied over the years ranging from various mechanical attachments (clamps, clips, etc) to adhesives. Each of the above types of hair weaving extensions and methods of attachment have various disadvantages.

As to the prior art, U.S. Pat. No. 6,708,696, issued on Mar. 23, 2003 to Ferguson discloses a Hairpiece and Method for Attachment. This patent shows a hair weave for attaching to hair using rings to link the natural hair through but rings are in chain-like fashion. U.S. Pat. No. 7,252,093 to Rodriguez discloses Hair Extension Methods & Related Devices patented on Aug. 8, 2007. This patent shows a method for attaching a weave of hair using a custom tie piece and employing a hand tool which is a looping device for manipulating the hair. U.S. Pat. No. 7,343,921 to Salinas for a Hair Extension was patented on Mar. 18, 2008. This patent shows a hair extension kit and the accompanying utensils wherein a hair piece is attached to hair by way of a strip that has a plurality of holes that the natural hair is pulled through and then woven about the strip containing the hair extension. U.S. Patent Publication No. 2005/0194015 to Watts for an Instant Hair Extension and Method for Attaching was issued on Sep. 9, 2005. This patent shows a "half-wig" type of hair attachment having a series of comb-like devices that are used to attach the hair extension to the natural hair.

SUMMARY

The present invention comprises various embodiments for making a hair weave tract extension apparatus and a method of making and using said apparatus. Embodiments are described and shown herein for making and using a hair weave tract apparatus with attachment means comprising a crimped flexible band and, and with attachment means comprising a crimped flexible band with a single bladed comb. It is an object of this present invention to provide a hair weave tract extension that is easy to attach to the natural hair, is less damaging to the natural hair and remains more securely attached to the natural hair. The present invention can be attached to natural hair without thread, needles, sewing, pins or glue, which allows for much less damaging hairstyles. Furthermore, the present invention is very simple to use and attach to natural hair and allows for many versatile hairstyles. None of the above inventions, patent, and disclosures taken either singularly or in combination, is seen to describe the instant invention a teaching or showing of a hair weaving tract with a crimped flexible band and/or a hair weaving tract with a single bladed comb & crimped flexible band as well as the method of making or using these and/or the designs of these elements.

DETAILED DESCRIPTION

Embodiments of the present disclosure are described herein with reference to the drawings. Embodiments are described and shown for making and using a hair weave tract apparatus with attachment means comprising a crimped flexible band in one embodiment; and with attachment means comprising a crimped flexible band with a single bladed comb in another embodiment.

Figure 1:
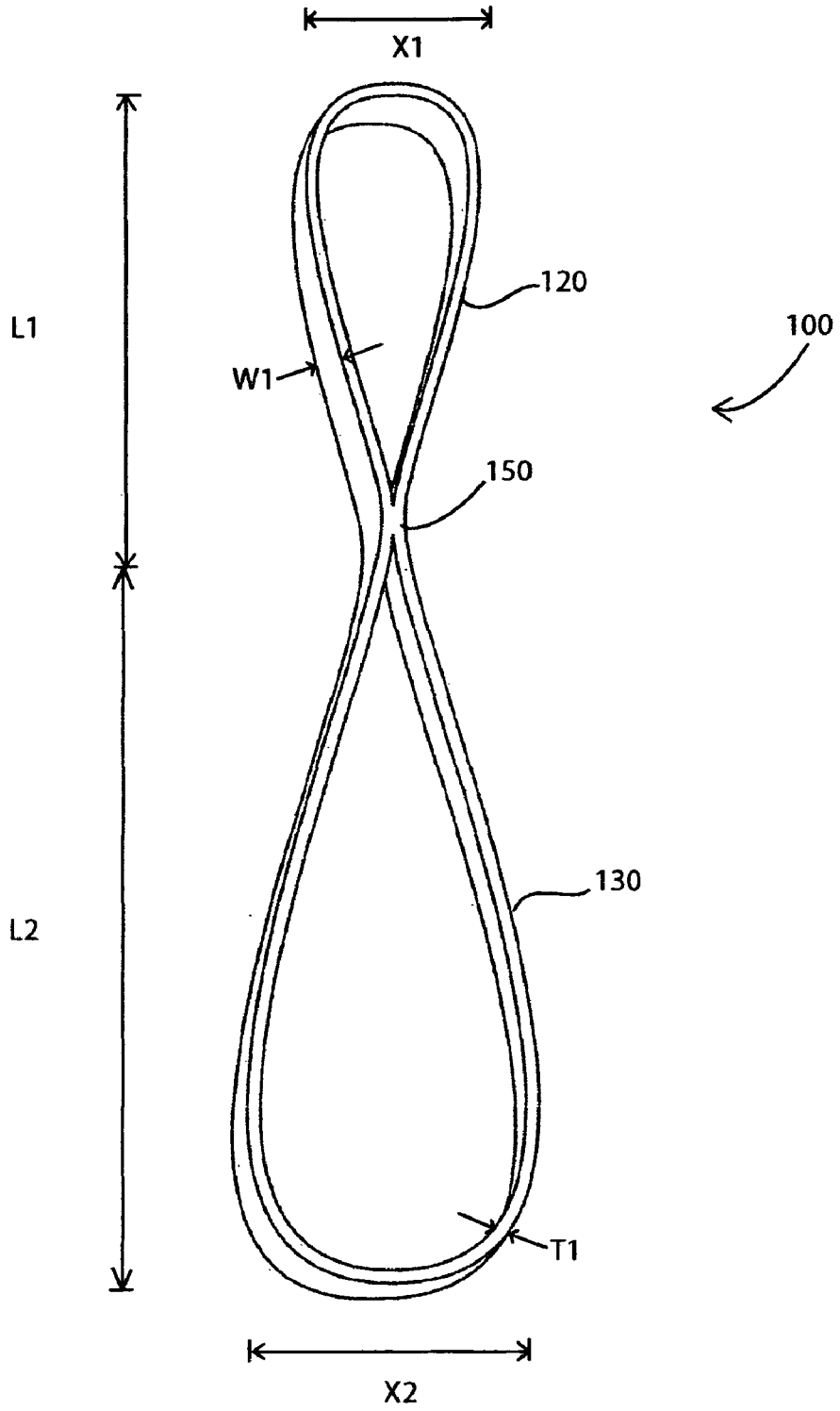
FIG. 1 shows a perspective view of the crimped flexible band comprising weave attaching means according to an embodiment of the present disclosure.

FIG. 1 shows a perspective view of the weave attaching means comprising a crimped flexible band 100. The crimpled flexible band (CFB) 100 serves to attach the weave of hair to a person's head of hair. The structure, shape and material composition of the band 100 aide in keeping the natural hair of the wearer attached to the weave. In some embodiments, the CFB 100 may be made of a rubberized, elastomeric material as is common to rubber bands which provides friction forces for facilitating attachment to the weave of hair.

As can be gleaned in FIG. 1, in one embodiment, the CFB 100 may assume the shape similar to the figure eight having two loop portions. The first loop portion 120 and the second loop portion 130 are formed due to the crimp 150 in the band structure. The crimp 130 may be formed by either physically mechanical means, such as, for example a pinched crimp of the material at the crimp 150; or via non-mechanical means such as bonding agents known in the art, or molding the crimp 150 via die casting methods during the manufacturing process, as is also well known in the art.

The CFB 100 may be sized and dimensioned to have a width defined as W1 and a thickness defined as T1; wherein W1>T1. Furthermore, the CFB 100 may be dimensioned such that the first loop portion 120 has a length L1 and width X1; and a second loop portion 130 having a length L2 and a width X2. It thus follows that in one embodiment:

L2 is ≈2L1;

X1<X2; and

The total length of CFB 100=L1+L2 which is ≈1 inch or less.

Figure 2:
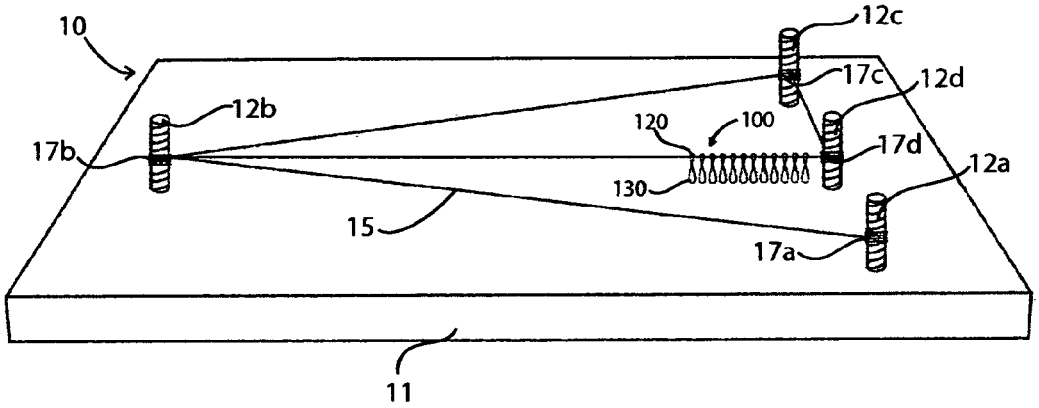
FIG. 2 is a perspective diagram of a weave tract table comprising an array of crimped flexible bands according to an embodiment of the present disclosure.

FIG. 2 is a perspective diagram of a weave tract table 10 comprising a base board member 11 serving as a working surface with a set of peg members 12*a*-12*d* extending vertically therefrom for receiving weaver threading 15. The weave threading 15 is woven about the peg members 12*a*-12*d* in a triangulation method wherein the thread 15 is first wrapped around the first peg 12*a* and wrapped around the peg 12*a* several times forming a wrapping 17*a;* and then subsequently about the second peg 12*b* and similarly forming a wrapping thereabout 17*b;* and then subsequently about the third peg 12*c* and similarly forming a wrapping thereabout 17*c;* and then subsequently about the fourth peg 12*d* and similarly forming a wrapping thereabout 17*d*. A triangulation of weave threading 15 is used on the tract table 10 to provide a means for attaching the synthetic strands of hair to the CFBs 100. Prior to wrapping the weave threading 15 around the first peg 17*a* again to form the last leg of the triangle, a set of CFB's 100 are added to the weaving thread line and then a final wrapping about peg 12*b* is performed.

Figure 3:
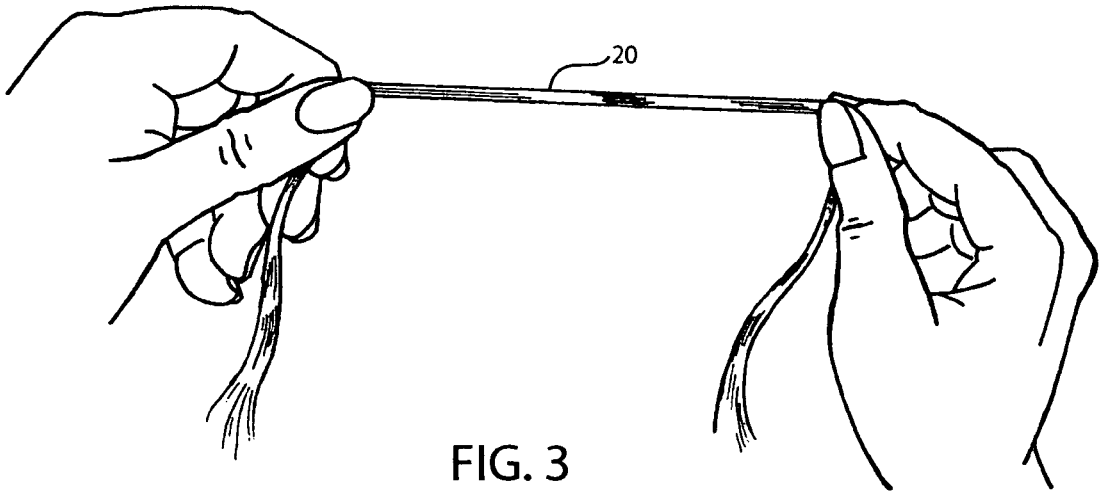
FIG. 3 shows an illustration of a method step of the selection of a strand of hair for weaving according to certain embodiments of the present disclosure.
Figure 4:
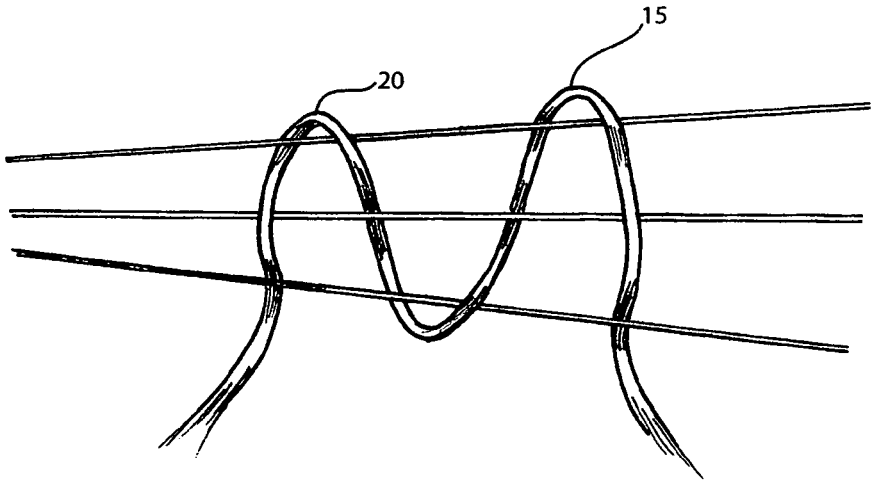
FIG. 4 shows an illustration of a method step of tying said strand of hair according to certain embodiments of the present disclosure.
Figure 5:
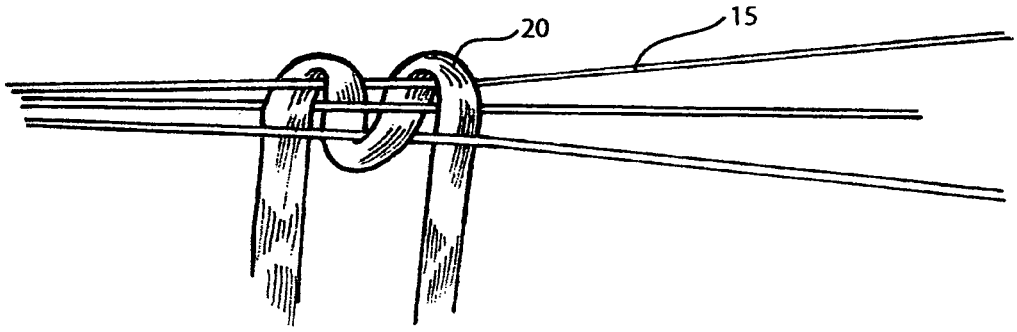
FIG. 5 shows an illustration of another method step of hand tying according to certain embodiments of the present disclosure.
Figure 6:
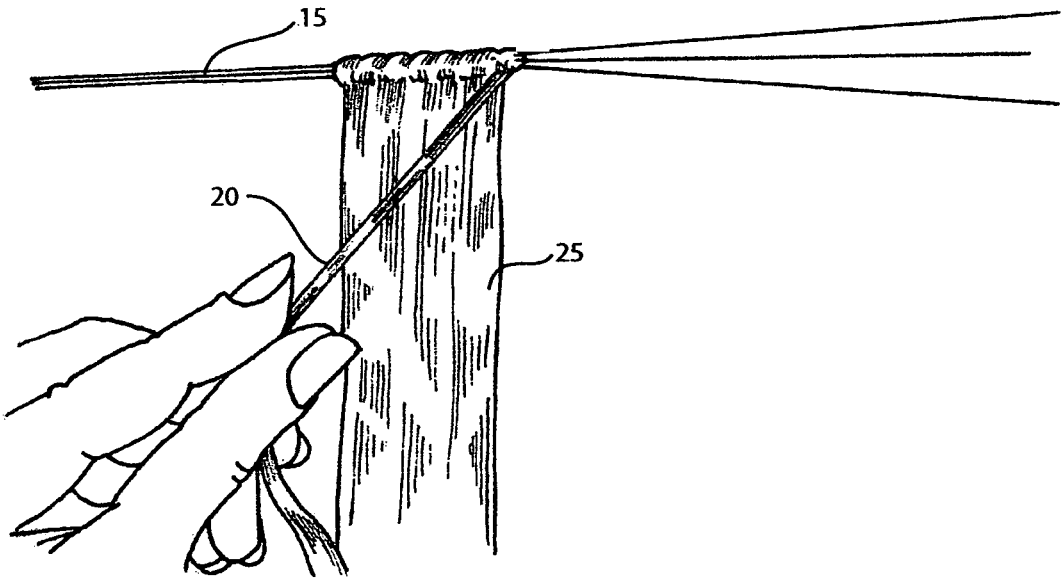
FIG. 6 shows an illustration of a further method step of hand tying according to certain embodiments of the present disclosure.
Figure 7A:
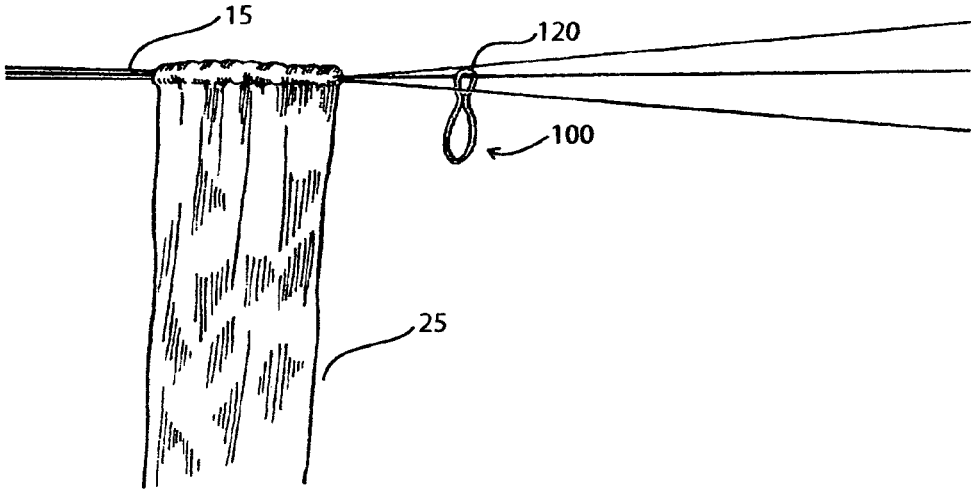
FIG. 7A shows an illustration of another method step of adding a flexible band to the tract in process according to certain embodiments of the present disclosure.
Figure 7B:
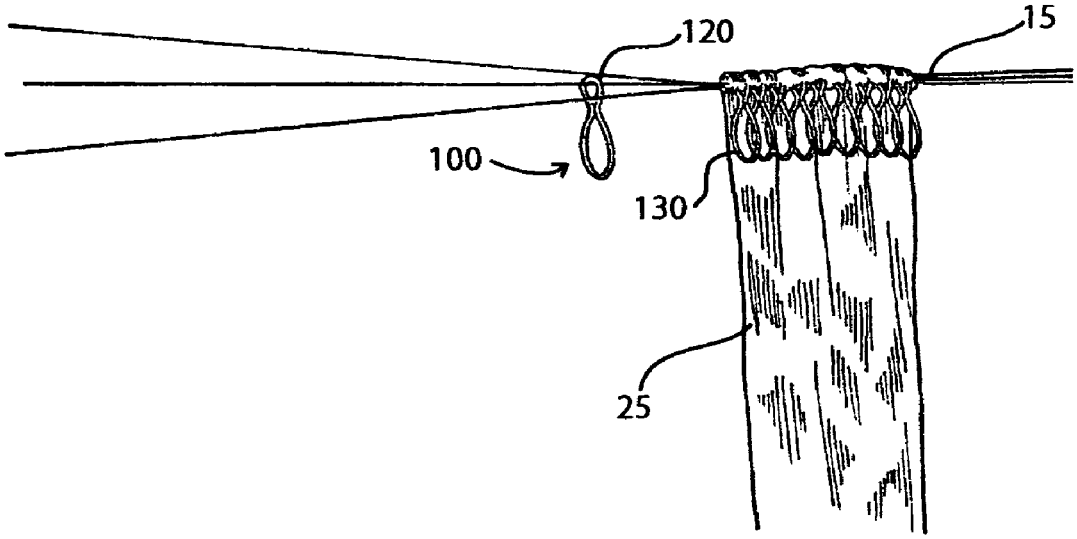
FIG. 7B is a rear perspective view of FIG. 7A according to certain embodiments of the present disclosure.
Figure 8:
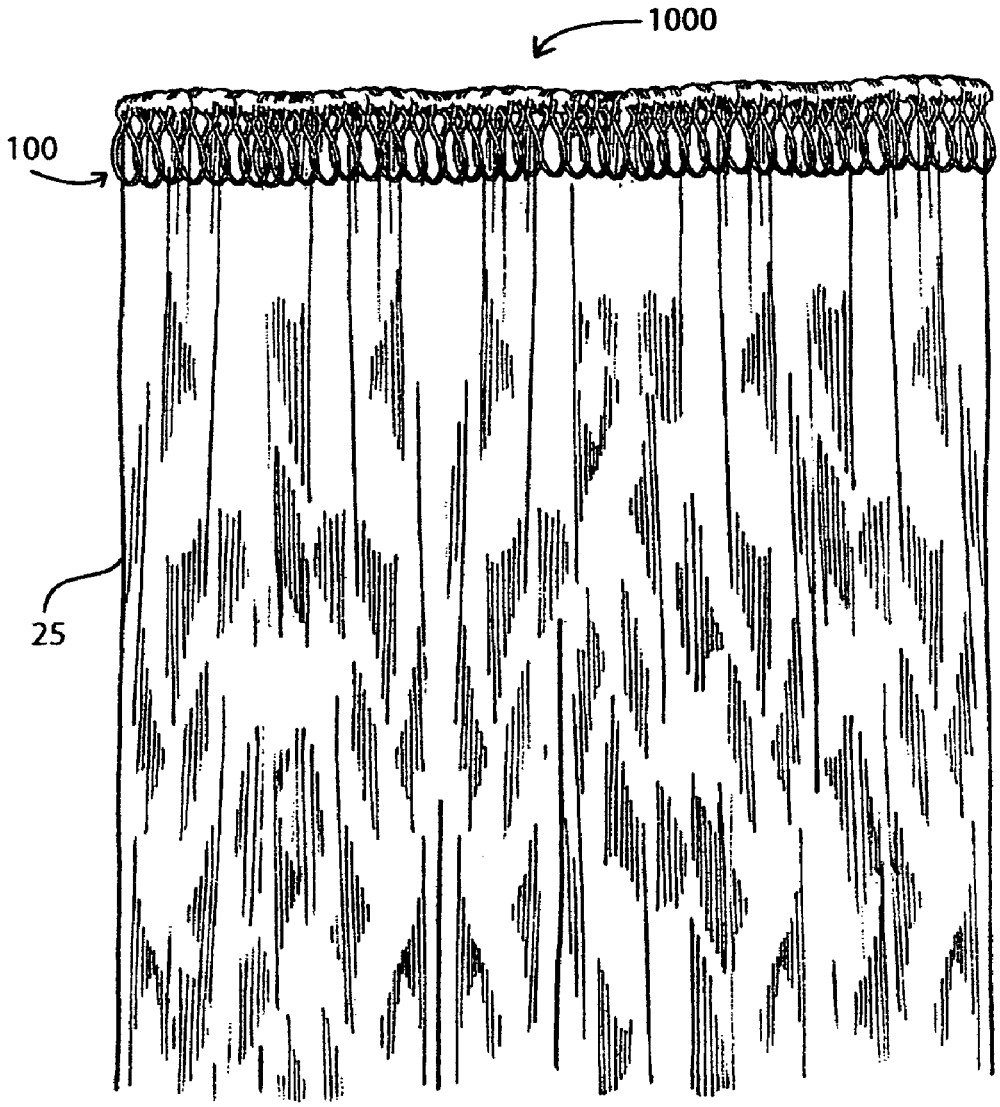
FIG. 8 is a rear perspective view of a completed tract of hair weave comprising the flexible band according to certain embodiments of the present disclosure.

The triangled weaving thread 15 is then removed from the tract table 10 in preparation for adding the weaving hair strands 20 (FIG. 3). As shown in FIG. 4, a set of hair weave strands 20 are threaded about the weaving thread 15. Once the weaving hair strands 20 are threaded about the weaving thread 15, they are pulled tightly about the weaving thread 15 which thus forms a sort of attachment thereto, see FIG. 5. As shown in FIG. 6, successive weaving hair strands 20 are threaded about the triangled weaving thread 15 until a tract of hair 25 is formed. As shown in FIGS. 7A&B, the CFB 100 is threaded about the weaving thread 15 for each successive weaving hair strand 20, and this is repeated until the desired amount and width of hair is threaded about the weaving threads 15 until a weave tract 1000 is formed, see FIG. 8.

Once the desired width of the tract of hair 25 is met, a further securing procedure is done wherein the attachment of the weaving hair strands 20 to the weaving thread 15 and the CFB 100 is reinforced and this may be done by a physical bonding step along the area where the three components meet. Physical bonding procedures known in the art may be performed, such as providing a stitching there across or using bonding agents (such as, for example, glues or adhesives) for securing the weaving hair strands 20, weaving thread 15, and the CFB 100 (as well as the CBCA 200 of the embodiment below).

Figure 9:
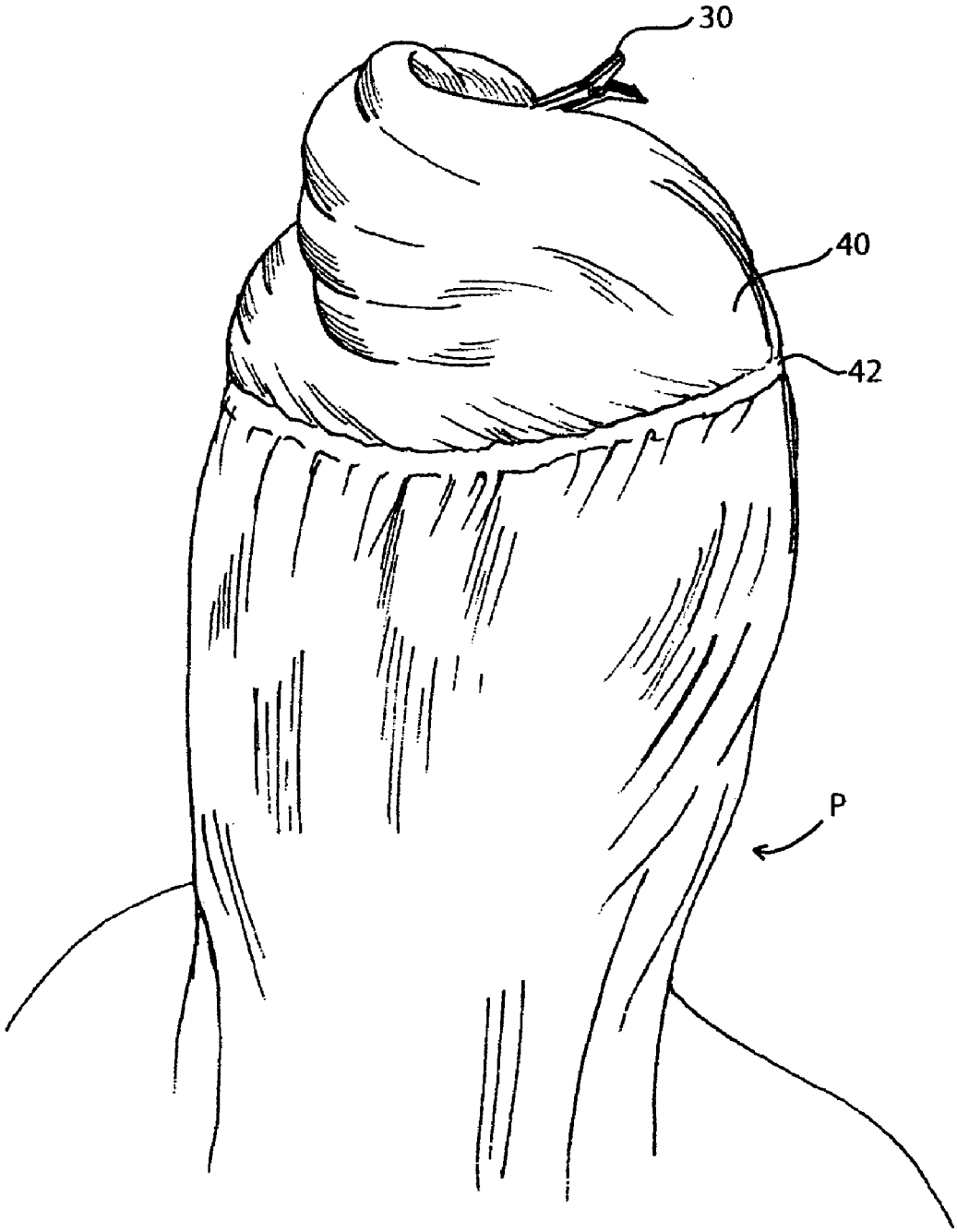
FIG. 9 is a diagram illustrating a method step of preparing a wearer's hair for the weave tract by parting the hair according to certain embodiments of the present disclosure.
Figure 10:
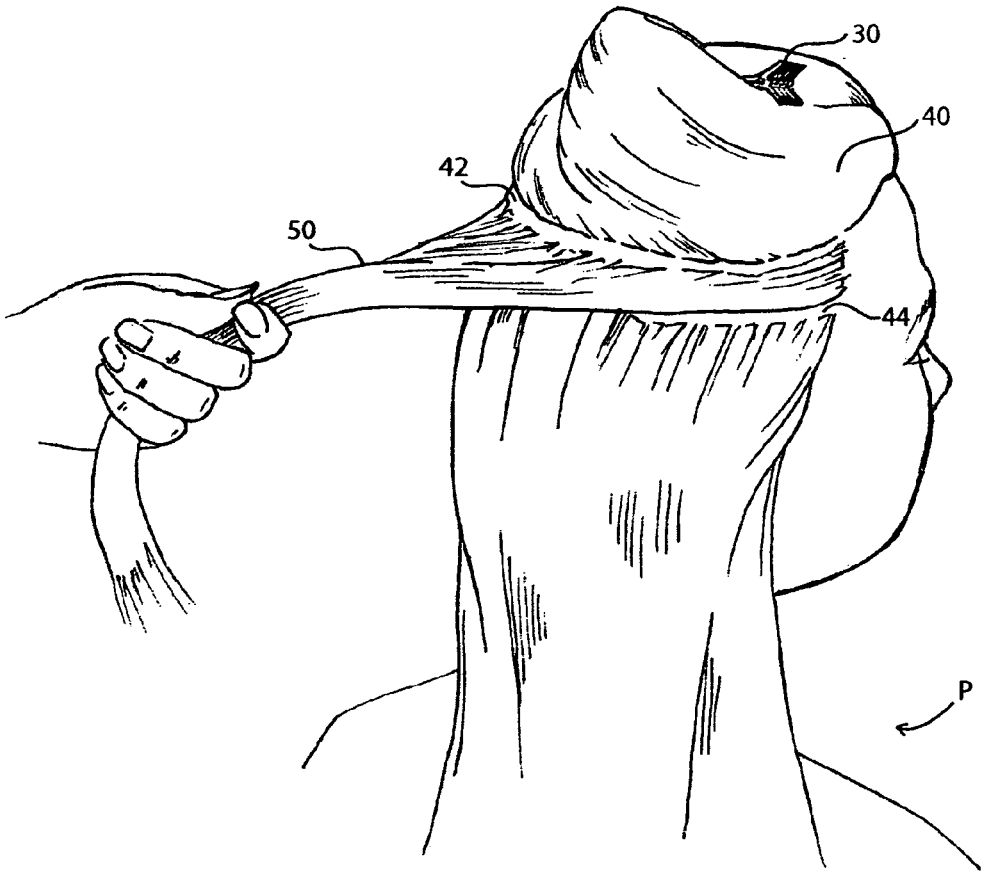
FIG. 10 is a diagram illustrating a further method step of preparing a wearer's hair for the weave tract by sectioning off a section of hair according to certain embodiments of the present disclosure.
Figure 11:
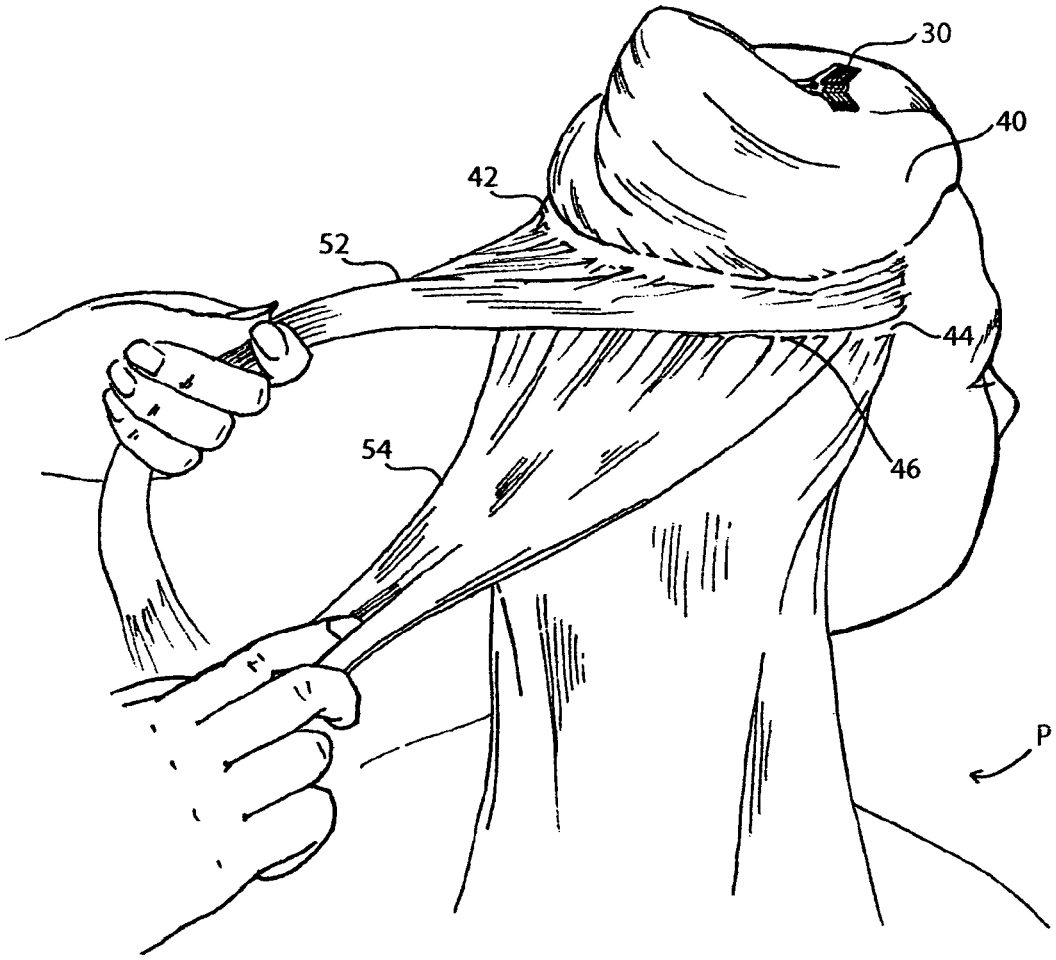
FIG. 11 is a diagram illustrating a further method step of preparing a wearer's hair for the weave tract by partitioning the section of the hair according to certain embodiments of the present disclosure.
Figure 12:
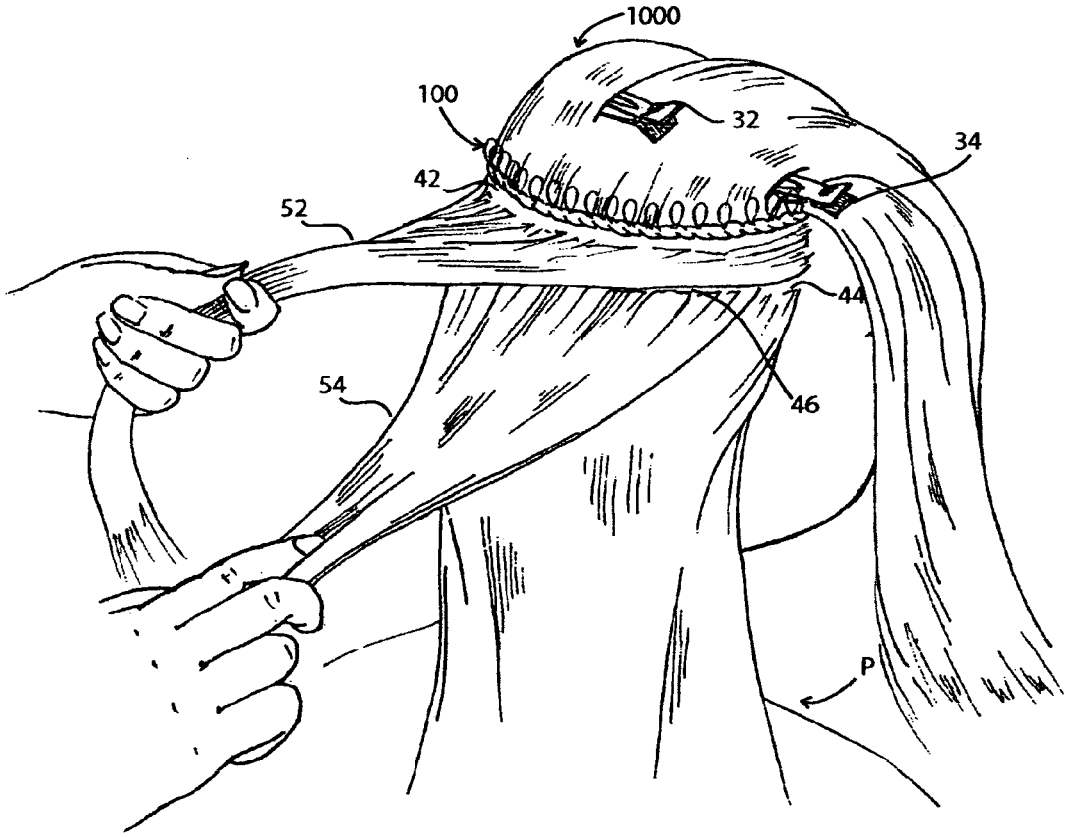
FIG. 12 is a diagram illustrating a method step of attaching the weave tract to a first section of the section of hair according to certain embodiments of the present disclosure.

FIG. 9 illustrates the originating step in attaching a weave tract 1000 to a wearer P of the weave. The natural hair 40 of the wearer P, is sectioned off into parts 42 and divided. Clips 30 may be employed to assist with the partitioning of the natural hair 40 in preparation for receiving the weave tract 1000. As shown in FIG. 10, a weaving section of hair 50 is gathered between a first part 42 and a second part 44. FIG. 11 illustrates a further step of partitioning the weaving section of hair 50 is divided into two further weave subsections 52 and 54, respectively, with a center part 46 guiding the division of the two weave subsections 52 and 54. Once the weave subsections 52 and 54 are divided, the weave tract 1000 is placed adjacent both the sectioned natural hair via dips 32 and 34, as well as the first of the two weave subsections 52 such that the CFB 100 can appropriately attach to the first of the two weave subsection 52, as shown in FIG. 12.

Figure 13:
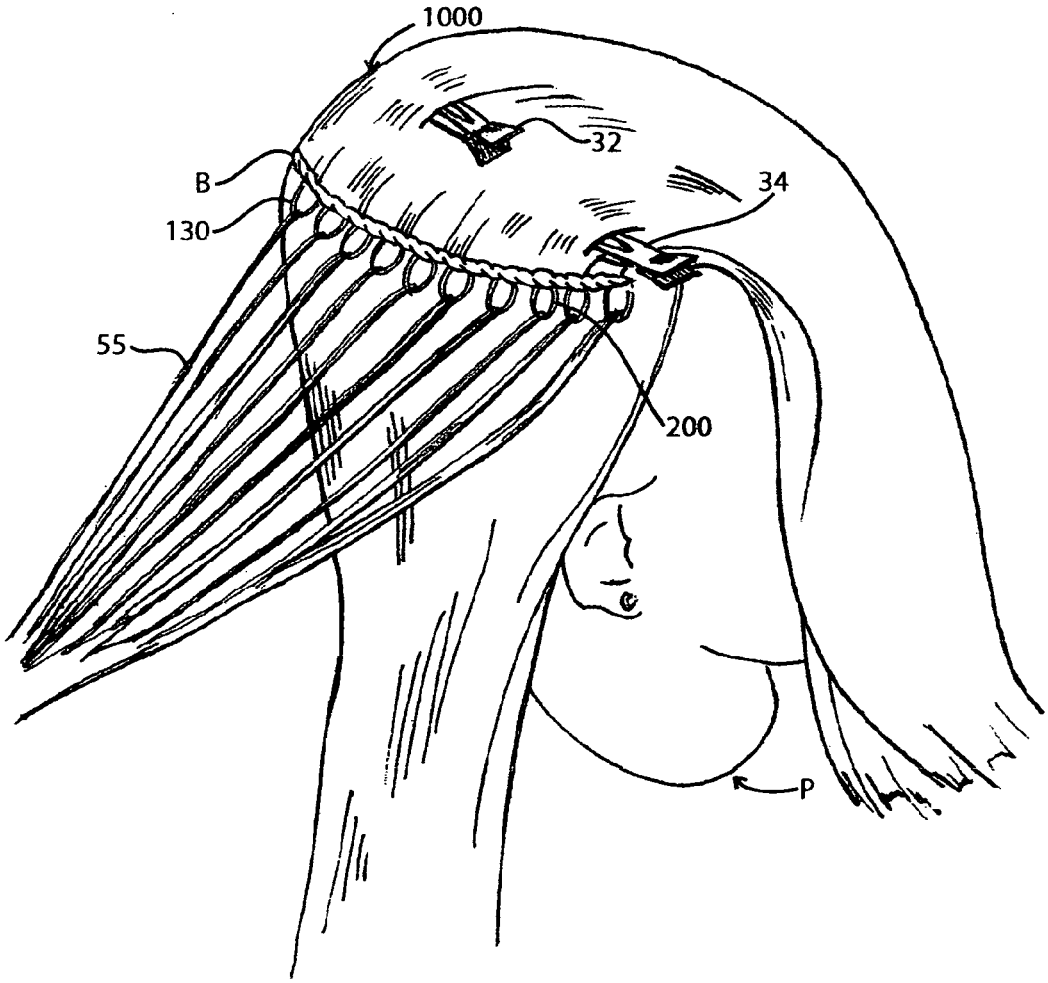
FIG. 13 is a diagram illustrating a further method step of attaching the weave tract to a first section of the hair by threading the natural hair through the loops of the flexible bands according to certain embodiments of the present disclosure.
Figure 14:
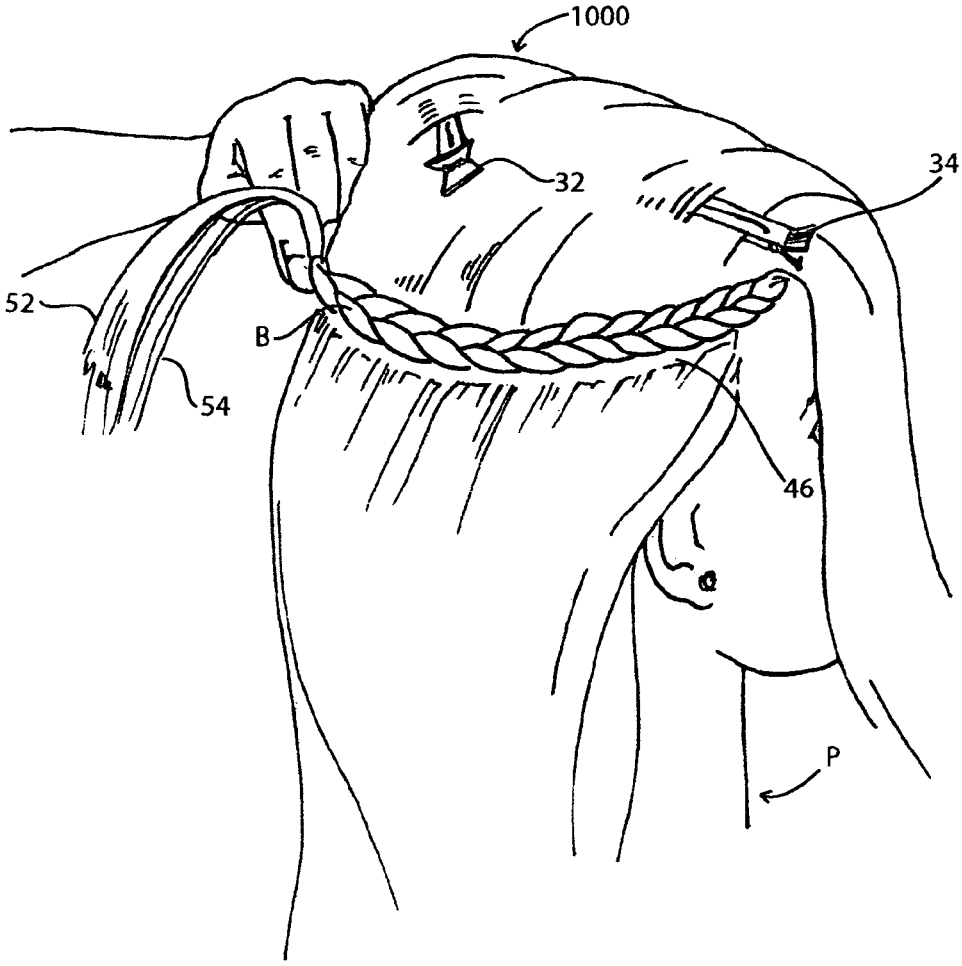
FIG. 14 is a diagram illustrating a further method step of attaching the weave tract to a first section of the hair by braiding remaining section of the hair to the looped hair extended through the bands according to certain embodiments of the present disclosure.
Figure 15:
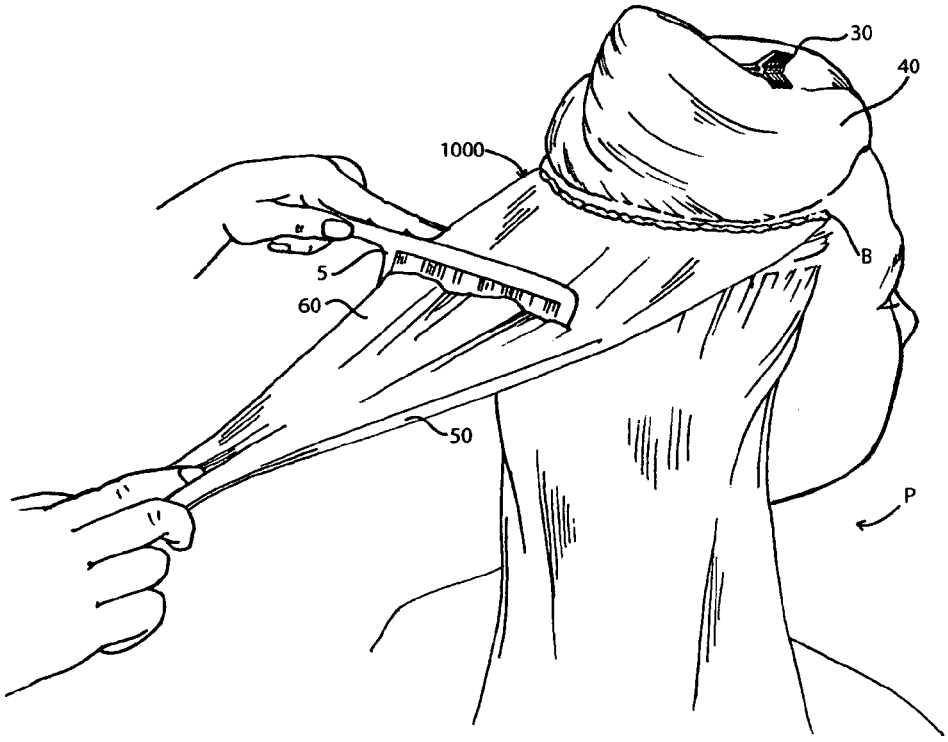
FIG. 15 is a diagram illustrating a method step of combing the weaved tract and blending it with the natural hair according to certain embodiments of the present disclosure.
Figure 16:
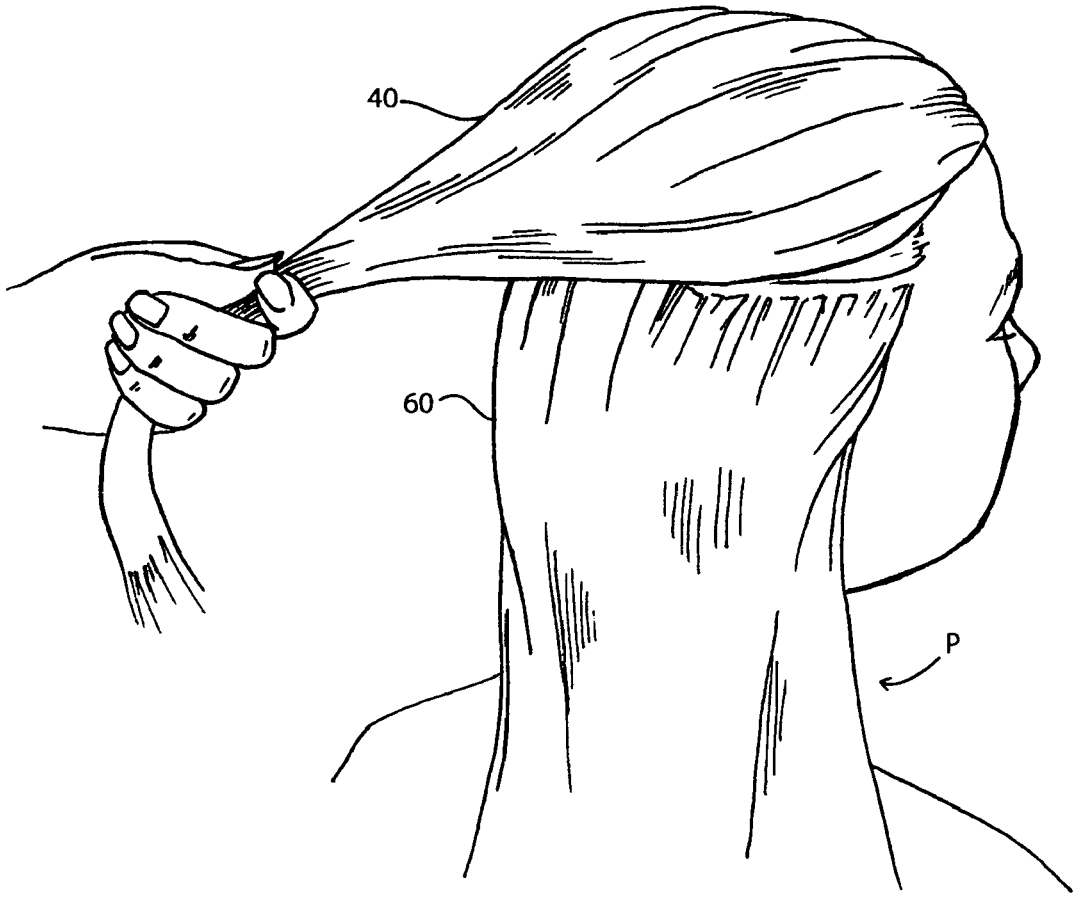
FIG. 16 is a diagram illustrating a further method step of blending the weaved tract with the entire natural hair according to certain embodiments of the present disclosure.

As can be gleaned in FIG. 13, to attach the weave tract 1000 to the natural hair 40 of the wearer P, natural hair strands 55 are threaded through the second loop portion 130 of CFB 100. Once this is done, the natural hair from the first of the two weave subsections 52 is braided with the natural hair strands 55 that have been threaded through the second loop portion 130, as shown in FIG. 14, thus forming a physical attachment thereto via a woven braid B. Once the weave tract 1000 has been fully attached via a woven braid B, the tract of hair 25 is blended with a hair manipulation apparatus 5, (such as a comb) with the weaving section of hair 50 and thereby forming a new combination of natural and weave hair blend 60, as shown in FIG. 15. Afterwards, the natural hair 40 may be unclipped and un-partitioned such that it can be added to the new combination of natural and weave blend 60 (see FIG. 16) for a finished effect of a new coiffeur 64 comprising both natural hair 40 and a woven in weave tract 1000.

Figure 18:
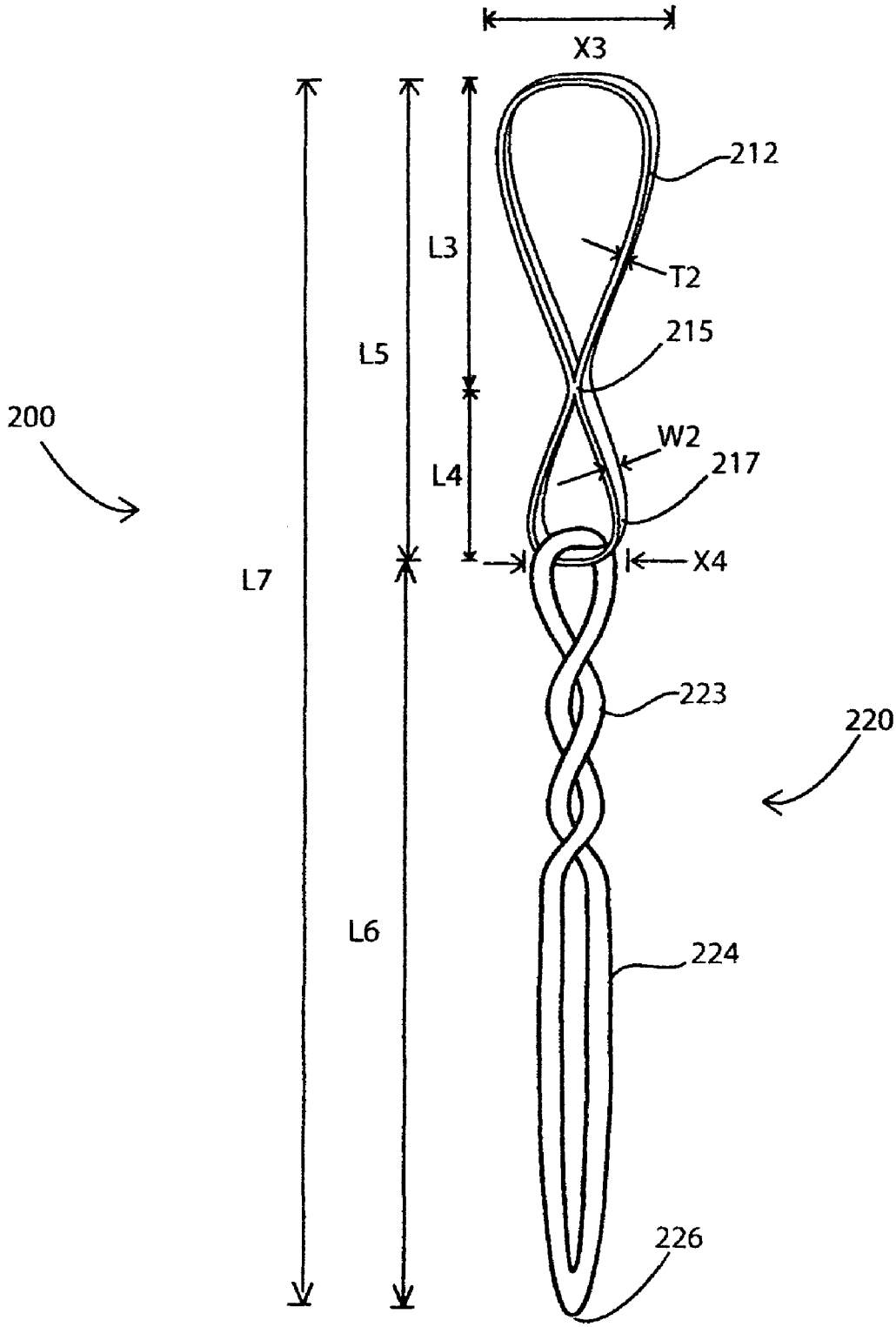
FIG. 18 is a perspective view of another embodiment of weave attaching means comprising a crimped flexible band attached to a single bladed comb according to another embodiment of the present disclosure.

FIG. 18 is a perspective view of another embodiment of weave attaching means comprising a crimped flexible band 210 attached to a single bladed comb (SBC) 220 which form a crimped band comb apparatus CBCA 200. The crimped flexible band 210 is comprised similarly of the same structure, dimensions, and materials as the CFB 100, and thereby has a first loop portion 212 and a second loop portion 217 separated by a crimped portion 215. The CBCA 200 is sized, structured and dimensioned to likewise have a width W2 and a thickness T2, (wherein W2>T2); and the length of the first loop portion 212 defined by L3 and the length of the second loop portion 217 defined by L4 (wherein L3 may be ≧L4); and wherein the width of the first loop portion 212 is defined by X3 and the width of the second loop portion 217 is defined by X4; and X3 may be ≧X4. Also, the SBC 220 may be defined in length by L6. Moreover, the CBCA 200 may be configured such that the overall dimension and size of each of the major components being the crimped flexible band 210 and the SBC 220, of the CBCA 200 may be of comparable dimensions such that the total length L5 of the crimped flexible band 210 is approximately equal to the length of the single bladed comb, L6. Therefore, in some embodiments, it follows that:

$L3+L4=L5$, and $L5 \approx L6$, and $L7 \approx L5+L6$.

The SBC 220 comprises first and second engaging portions, 223 and 224, respectively. The engaging portions provide structural support for engaging the weaving tract device with the natural hair of the wearer during the attachment phase. In one embodiment, the first engaging portion 223 may comprise a coiled like portion which may provide further frictional attaching means, in conjunction with the second engaging portion 224 comprising a tapered loop comb blade portion which tapers into a beveled tip 226 for facilitating engagement within the hair. In this embodiment, second engaging portion 224 is illustrated in a twisted loop fashion, however, it is to be appreciated by those of ordinary skill that another more unitary structure, such as for example a crimped or grooved section, may be employed as design and/or manufacturing considerations for either the first engaging portion 223 and/or the second engaging portion 224.

Although the crimped flexible band 210 is preferably comprised of a flexible material, the SBC 220 is comprised of a more rigid material which facilitates structural engagement within the hair during placement. Non-limiting examples of such rigid materials may include aluminum (or other well known soft metals), hard plastics, wood, and the like. The SBC 220 may also comprise an outer coating in some embodiments.

Figure 19:
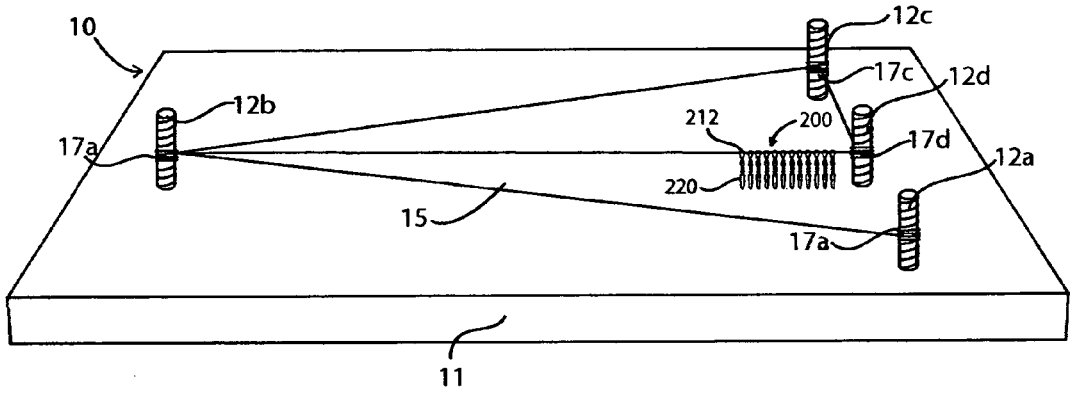
FIG. 19 is a perspective diagram of a weave tract table comprising an array of weave attaching means comprising a crimped flexible band attached to a single bladed comb according to an embodiment of the present disclosure.
Figure 20:
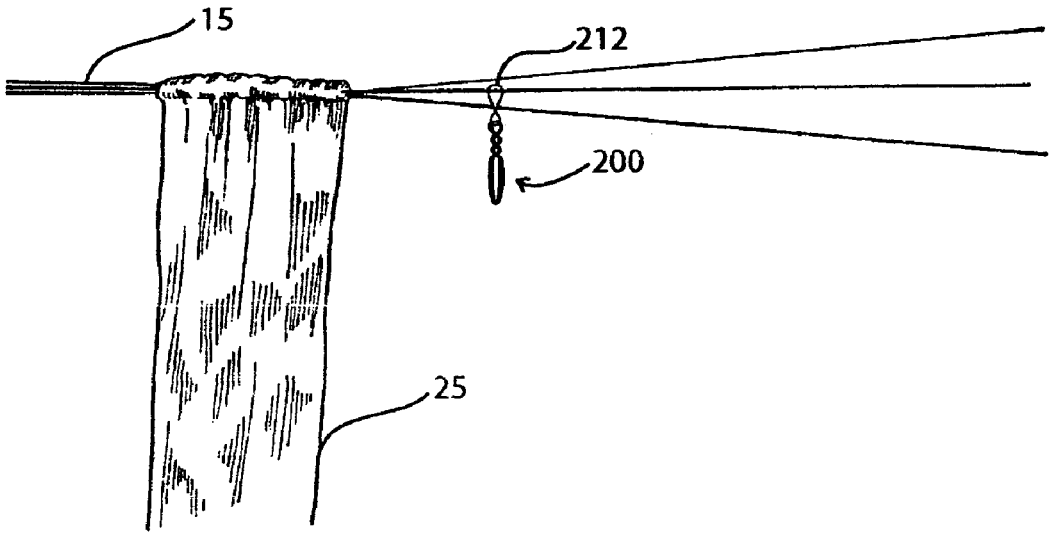
FIG. 20 shows an illustration of a method step of adding weave attaching means comprising a crimped flexible band attached to a single bladed comb to the tract in process according to certain embodiments of the present disclosure.
Figure 21:
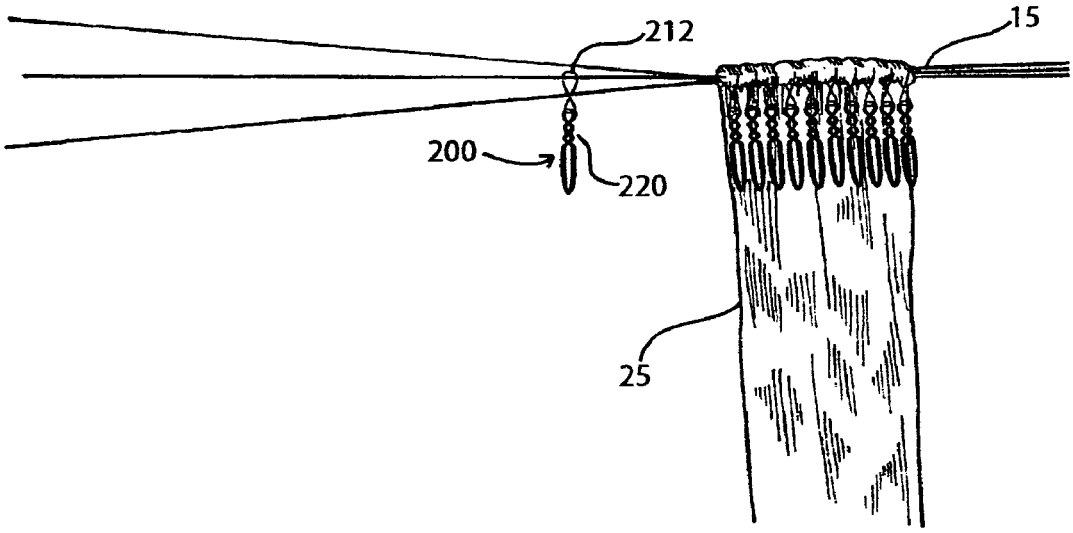
FIG. 21 is a rear perspective view of FIG. 20 according to certain embodiments of the present disclosure.
Figure 22:
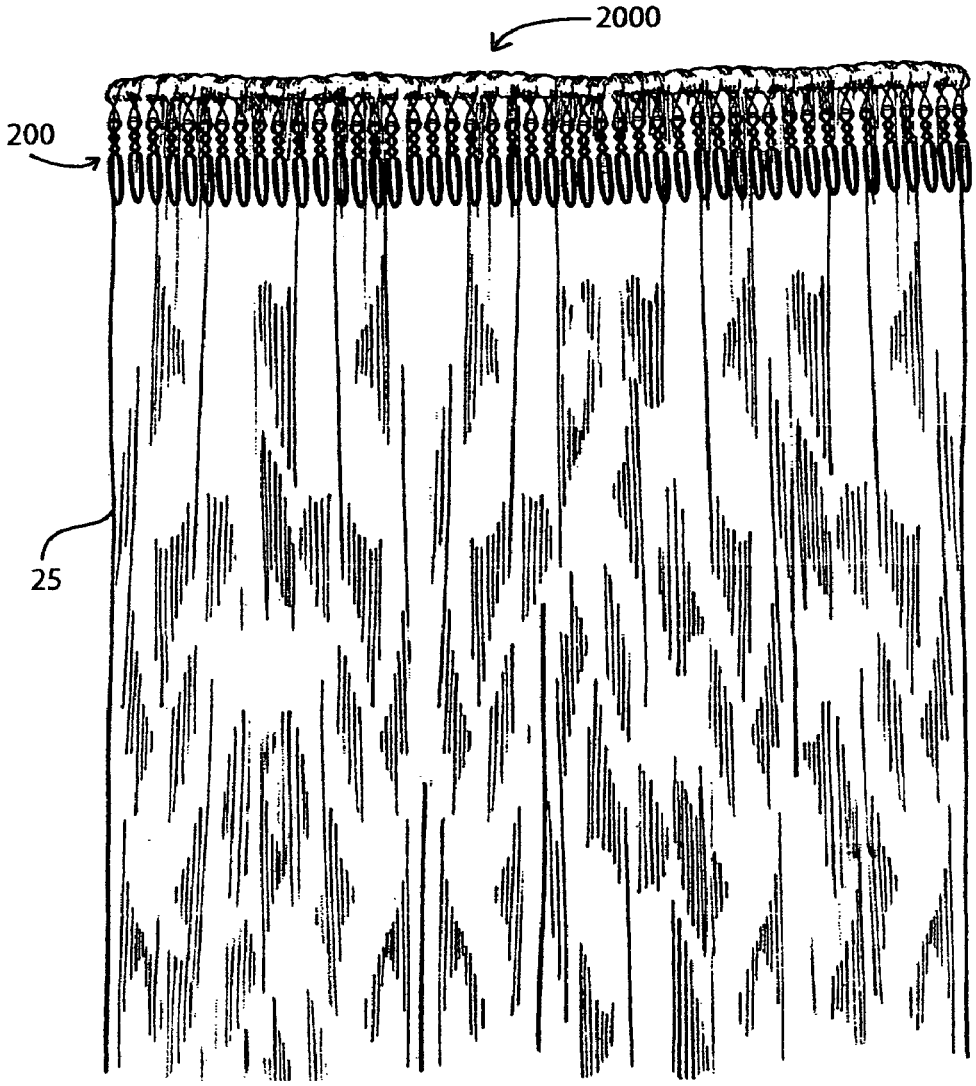
FIG. 22 is a rear perspective view of a completed weave tract having an array of weave attaching means, comprising a crimped flexible band attached to a single bladed comb.

The CBCA 200 is attached to weaving hair in a similar fashion as the prior embodiment wherein a tract table 10 may be employed to secure weaving threads 15 to sets of CBCA's 200, as shown in FIG. 19, for subsequent attachment to a tract of hair 25 as shown in FIGS. 20 and 21. The method steps for attaching the CBCA 200 to hair weave to form the weave tract 2000 (FIG. 22) are congruent with the above procedure as described in FIGS. 3-7B, with the weave threading 15 being threaded through the first loop portion 212 for this particular embodiment.

Figure 23:
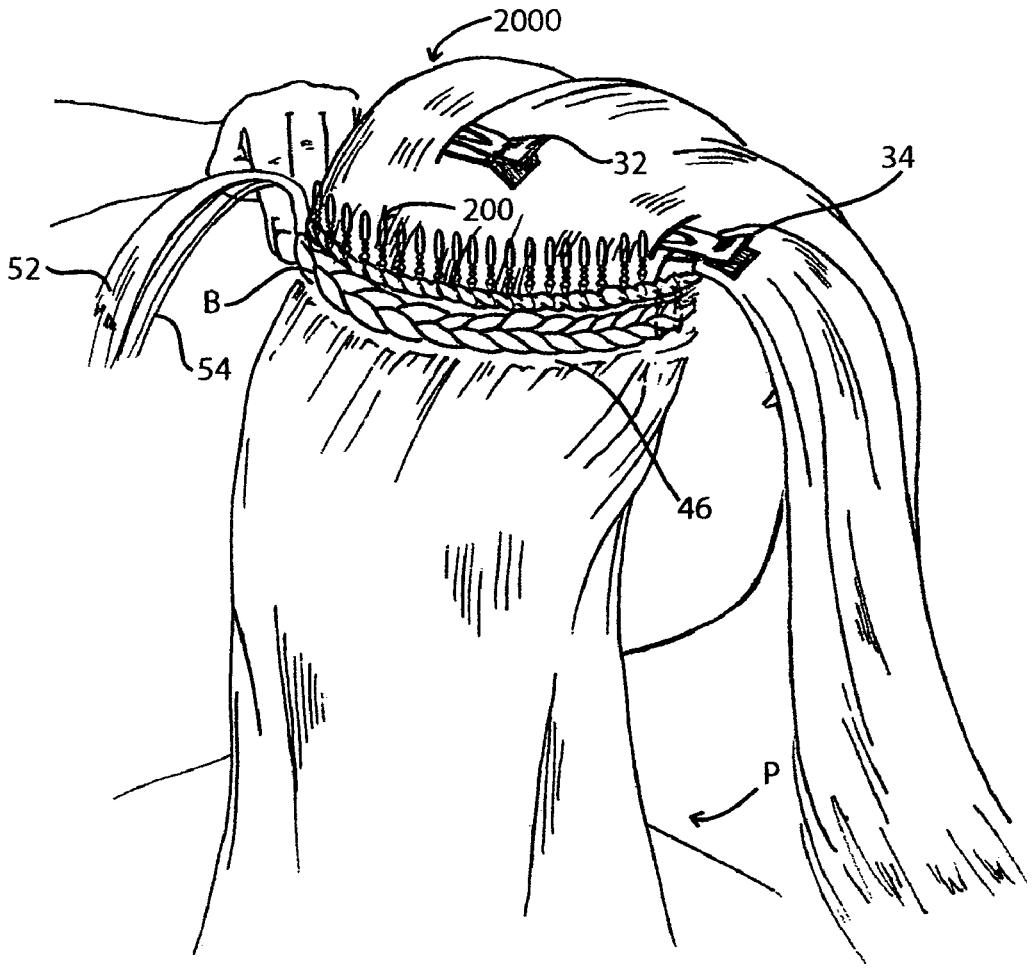
FIG. 23 is a diagram illustrating a method step of attaching the weave tract, comprising a crimped flexible band attached to a single bladed comb, to a braided section of hair according to certain embodiments of the present disclosure.

The method steps of partitioning and sectioning the sections of natural hair 40 in preparation for attaching the hair weave tract 2000 is as described above with reference to FIGS. 9-12 similarly applies to preparing to attach hair weave tract 2000 of the instant embodiment. Moreover, the method of steps of threading natural hair strands 55 through the second loop portion 212 of the CBCA 200 is performed similarly as illustrated in FIG. 13, to thus form a layer of hair to form a braid B, as shown in FIG. 23, which physically attaches the natural hair to the hair weave tract 2000.

Figure 17:
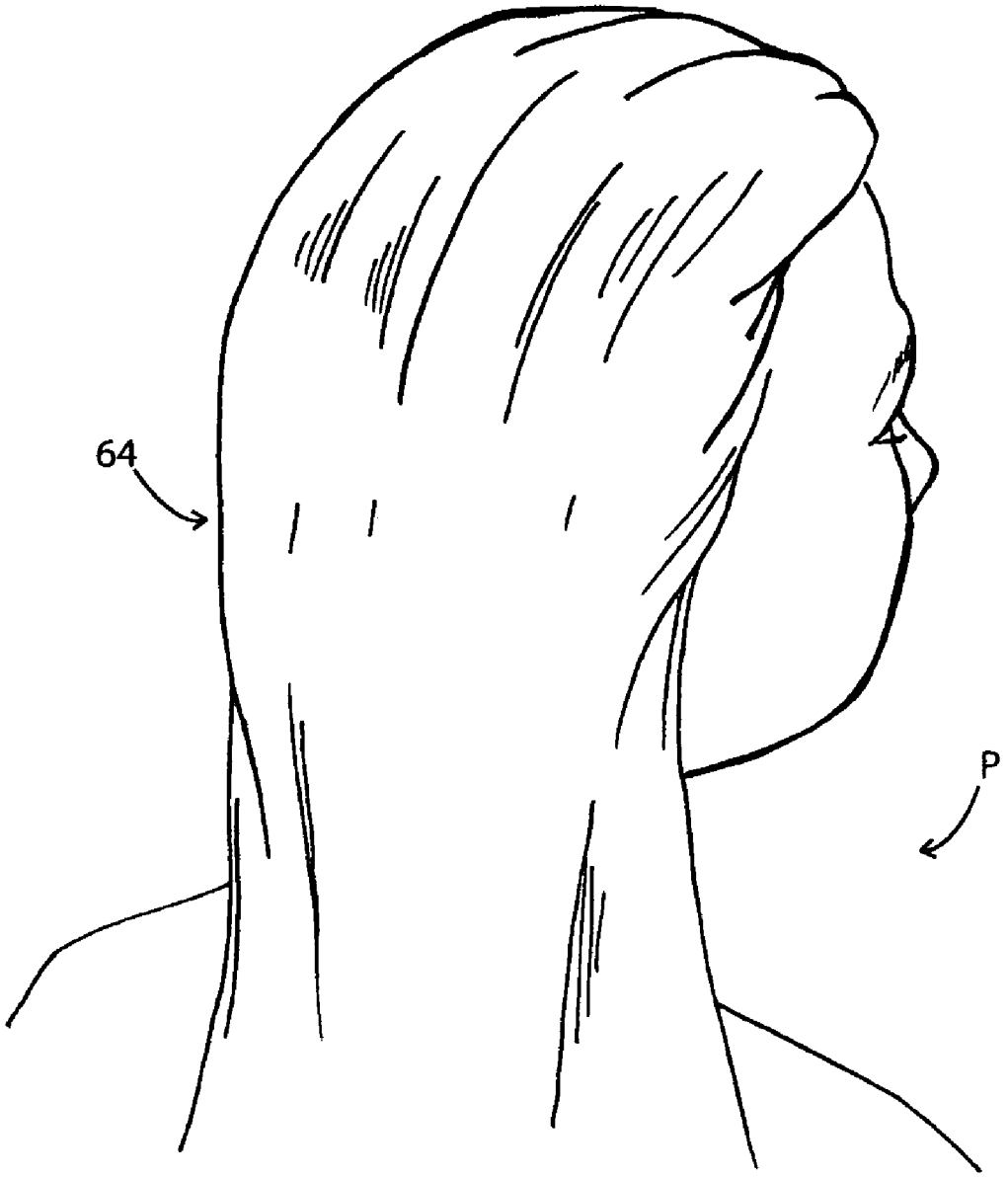
FIG. 17 is a diagram illustrating a wearer of the hair weave tract invention according to certain embodiments of the present disclosure.
Figure 24:
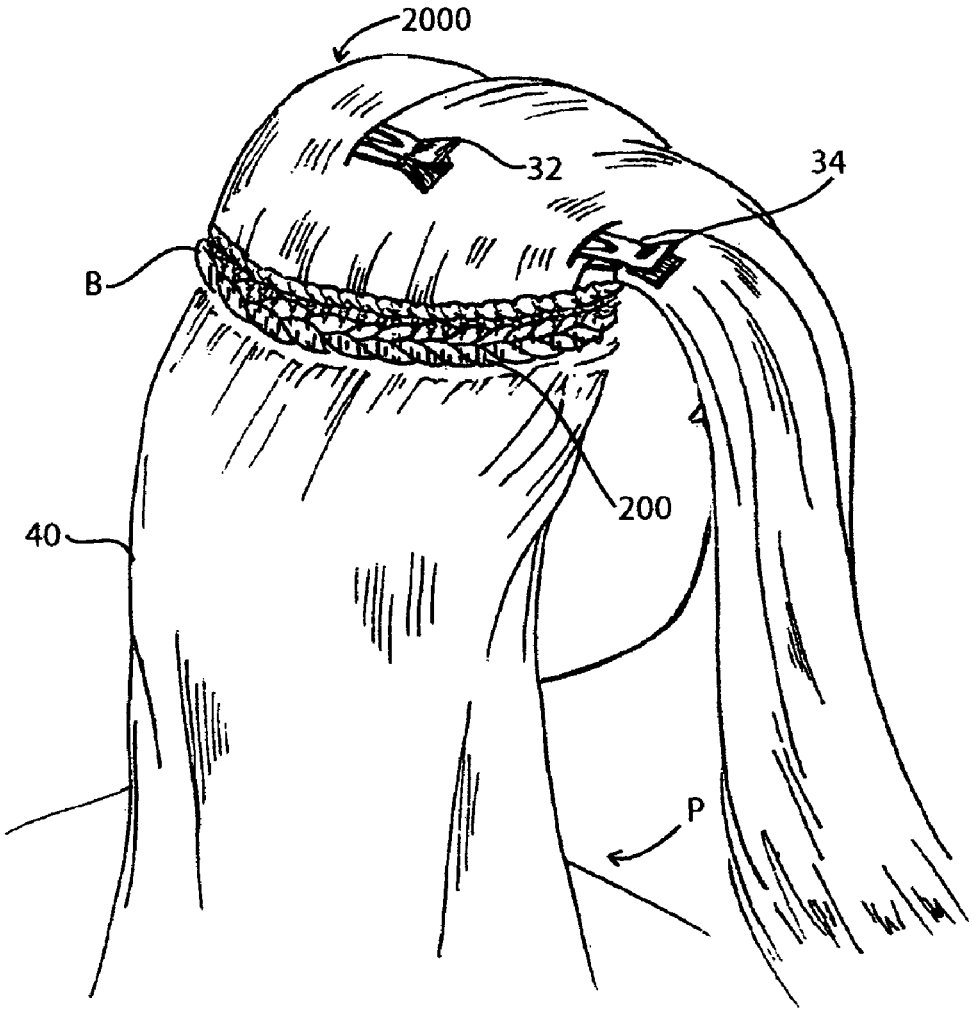
FIG. 24 is a diagram illustrating a method step of attaching the weave tract, comprising a crimped flexible band attached to a single bladed comb, to a braided section of hair by inserting the array of single bladed combs between the braids of the braided portion of hair according to certain embodiments of the present disclosure.

The weaved hair tract 2000 is placed adjacent the natural hair 40 such that after the braid B has been formed, the CBCA 200 is in an upright fashion with the SBC 220 in a vertically upright oriented position such that the first and second engaging portions 223 and 224, respectively, are turned in a downward direction toward the braid B, and inserted with the beveled tip 226 betwixt the woven braid B for a secured placement of the weave hair tract 2000 within the natural hair 40 as shown in FIG. 24. In a manner similar to the method steps illustrated in FIGS. 15 and 16, the natural hair 40 is blended with the weaved in hair to produce a finished effect of a new coiffeur 64 comprising both natural hair 40 and a woven in weave tract 2000 similar to that which is illustrated in FIG. 17.

In the foregoing manner, exemplary embodiments of the present disclosure are described with reference to the figures. Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used and/or to the particular embodiment disclosed as the best mode contemplated for carrying out this invention, but that the invention will include any and all embodiments and equivalents falling within the scope of the instant disclosure.

For example, the weave tract hair may be comprised of either synthetic hair, human hair or blends thereof, as is well known in the art. Further, the width of the weave hair tract maybe of a predetermined width depending on the need of the wearer and may begin at a range starting from, for example approximately one inch wide or greater depending on the area of head coverage needed by the wearer of the weave. The method step of extending the length of the hair weave tract and weaving the hair weave strands with the weave attachment means (i.e., crimped flexible bands or crimped flexible bands with the single bladed combs) may be repeated over and again to produce the desired width of the weave tract. Moreover, the length of the hair tract may be made to extend as long as the wearer desires such as one inch or six inches, or twelve, twenty, thirty-six, forty, fifty inches or longer. It is to be understood by an artisan of skill in the art that the dimension of the weave tract may vary.

The color of the hair tract may also depend on the desires of the wearer in that they may want to match the hair or provide color highlights to their natural hair, and thus the weave hair and components thereof may be comprised of material matching the desired hair color and/or dyed to achieve the color effect needed for the weave tract (e.g., browns, black, gray, blond, reds, etc.).

The foregoing description of illustrated embodiments of the present invention, including what is described, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

What I claim for Letters Patent is:

1. A hair weave tract for attaching to the natural hair of a wearer, said hair weave tract comprising:

a plurality of crimped flexible bands, said crimped flexible bands having a crimp forming two apertures, said two apertures forming first and second attachment loop means; and a plurality of hair weave strand sets for forming the weave hair; and wherein said hair weave tract comprises a horizontal axis and a vertical axis, and wherein the plurality of crimped flexible bands are coupled to the horizontal axis of said hair weave tract with said first attachment loop means, and wherein said plurality of weave strand sets have a length and said length extends along the vertical axis of said hair weave tract; and said hair weave tract further comprises weave threading comprising a set of at least three strands for attaching said weave strand sets to said plurality of crimped flexible bands, and said weave threading coupling said plurality of crimped flexible bands to said plurality of hair weave strand sets.

2. The hair weave tract of claim 1, wherein wherein said first attachment loop means is configured to threadably receive at least one of said weave threading strands; and wherein said second attachment loop means is configured to threadably receive natural hair strands of the wearer with said second aperture.

3. The hair weave tract of claim 2, wherein said first and second attachment loop means are each defined by a dimension comprising a length and width, and wherein the crimped flexible band has a width greater than its thickness, and wherein said length of said first attachment loop means is less than the length of the second attachment loop means.

4. The hair weave tract of claim 3, wherein wherein said length of said first attachment loop means is approximately half the length of said second attachment loop means.

5. The hair weave tract of claim 4, wherein said weave tract comprises three or more flexible crimped bands per inch of weave tract hair along the horizontal axis of the hair weave tract.

6. The hair weave tract of claim 5, wherein said hair weave strands are each approximately a quarter of an inch or less in width, and at least one inch in length.

7. A hair weave tract for attaching to the natural hair of a wearer, said hair weave tract comprising:

a plurality of weave attachment means each of said weave attachment means comprising a crimped flexible bands, and a single bladed comb a plurality of hair weave strand sets for forming the weave hair, and said plurality of weave attachment means operatively coupled to said plurality of hair weave strand sets; and wherein said crimped flexible bands having a crimp forming two apertures, said two apertures forming first and second attachment loop means, said single bladed comb operatively coupled to said second attachment loop of said crimped flexible band; and wherein said single bladed comb has first and second engagement portions adjacent one another for providing physical securement within the hair of a wearer, and wherein the first engagement portion has frictional attaching means, and wherein the second engagement portion comprises a beveled tip for securing placement of the single bladed comb within the hair of the wearer.

8. The hair weave tract of claim 7, wherein said hair weave tract comprises a horizontal axis and a vertical axis, and wherein the plurality of crimpled flexible bands are coupled to said first attachment loop means along said horizontal axis, and wherein said plurality of weave strands have a length and said length extends along the vertical axis of said hair weave tract.

9. The hair weave tract of claim 8, further comprising weave threading comprising a set of at least three strands for attaching said weave strands to said plurality of crimped flexible bands, and said weave threading coupling said plurality of crimped flexible bands to said plurality of hair weave strands; and wherein said first attachment loop means is configured to threadably receive at least one of said weave threading strands; and wherein said second attachment loop means is configured to threadably receive natural hair strands of the wearer with said second aperture.

10. The hair weave tract of claim 9, wherein said first and second attachment loop means are each defined by a dimension comprising a length and width, and wherein the crimped flexible band has a width greater than its thickness, and wherein said length of said first attachment loop means is less than the length of the second attachment means.

11. The hair weave tract of claim 10, wherein wherein said length of said first attachment loop means is approximately half the length of said second attachment means; and wherein the crimped flexible bands and the single bladed comb are sized and configured such that they are approximately the same dimension

12. The hair weave tract of claim 11, wherein said weave tract comprises three or more flexible crimped bands per inch of weave tract hair along the horizontal axis of the hair weave tract.

13. The hair weave tract of claim 12, wherein said hair weave strands are each approximately a quarter of an inch or less in width, and at least one inch in length.

* * * * *